US005971109A

United States Patent [19]

Aulanko et al.

[11] Patent Number: 5,971,109

[45] **Date of Patent: *Oct. 26, 1999**

[54] ARRANGEMENT FOR RELEASING THE BRAKE OF AN ELEVATOR MACHINERY

[75] Inventors: Esko Aulanko, Kerava; Harri Hakala; Jorma Mustalahti, both of Hyvinkaa, all of Finland

[73] Assignee: Kone Oy, Helsinki, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,172

[22] Filed: May 9, 1997

[30] Foreign Application Priority Data

Sep. 5, 1996 [FI] Finland ..... 963473

[51] Int. Cl.[6] ..... B66B 11/08

[52] U.S. Cl. ..... 187/263; 187/350

[58] Field of Search ..... 187/263, 266, 187/350, 351, 377, 359, 356, 336; 188/188, 189

[56] References Cited

U.S. PATENT DOCUMENTS 5,680,911 10/1997 Wang ..... 187/350

FOREIGN PATENT DOCUMENTS

| | | | |
|---|---|---|---|
| 95436 | 10/1995 | Finland . | |
| 3419443 | 11/1985 | Germany . | |
| 1-236188 | 9/1989 | Japan . | |
| 2-033080 | 2/1990 | Japan . | |
| 2-095680 | 6/1990 | Japan . | |
| 4-235879 | 8/1992 | Japan . | |
| 406211472 | 8/1994 | Japan | 187/350 |

*Primary Examiner*—Kenneth Noland

*Attorney, Agent, or Firm*—Birch, Stewart, Kolasch & Birch, LLP

[57] ABSTRACT

A manually activated elevator braking release including an actuating element placed away from the brake and a mechanical power transmission system for transmitting releasing power from the actuator to a brake element. The actuator is placed on a landing and a window is provided near the actuator so that an operator can observe movement of the hoisting ropes and/or traction sheave. Arrival of the elevator car at one of the landing zones is indicated in a manner allowing it to be perceived from a position near the actuator.

19 Claims, 5 Drawing Sheets

ARRANGEMENT FOR RELEASING THE BRAKE OF AN ELEVATOR MACHINERY

The present invention relates to an arrangement for releasing the brake of an elevator machinery.

BACKGROUND OF THE INVENTION

To save building space, efforts have been made recently to find solutions for elevator machineries that are flat in the direction of the shaft of the traction sheave of the elevator. A flat design makes it easy to place the hoisting machinery in the elevator shaft. It is also technically possible to place the instrument panel containing the power electronics and elevator control system in the shaft. From the point of view of maintenance and installation, however, it would be desirable to have the instrument panel in a place where it is more easily accessible than in the elevator shaft. Moreover, allowing minor operations on the machinery without entering the elevator shaft would be an advantage.

When an elevator stops e.g. between floors as a result of a disturbance, it is important to get the passengers out of the elevator fairly quickly. Elevator machineries are provided with a mechanical brake releasing device which is used to release the brake to allow the elevator to be moved. The releasing device may be fixedly mounted in conjunction with the brake, or it may consist e.g. of a lever which is placed in the brake to release it.

A feature characteristic of prior-art solutions is that the person releasing the brake has to be in the immediate vicinity of the brake when releasing it. To release the brake of an elevator machinery, the releaser has to be able to observe the behavior of the machinery because allowing the elevator to move too fast will result in the activation of the safety gear.

As development of elevator systems has led to increasingly compact and efficient elevator machineries and as the space required by the control equipment has been reduced, it is no longer strictly necessary to provide an elevator with a machine room. The elevator machinery can be placed in the top part of the elevator shaft, beside the shaft, and so on. Still, the requirement that it must be possible to manually release the brake of the elevator machinery remains. Due to the placement of the machinery, the brake may be located in a place difficult to access for releasing. This is the case e.g. when the machinery is placed in the elevator shaft.

SUMMARY OF THE INVENTION

The object of the present invention is to present a new and easy-to-use mechanism for releasing the brake of an elevator machinery, that obviates the need to get close to the machinery in order to manually release the brake, especially in the case of an elevator machinery placed in the elevator shaft.

When the arrangement of the invention is used, it is not necessary to enter into the machine room or other space housing the elevator machinery, because the brake releasing device can be easily mounted in a desired place, e.g. near the elevator doors on the top floor. The releasing device is especially advantageous in conjunction with an elevator machinery placed in an elevator shaft.

Several brake units can be released simultaneously by one brake releasing device, and the device can be so adjusted that the releasing of the brakes occurs simultaneously.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described in the following by the aid of a few embodiments by referring to the attached drawings, which are given by way of illustration only, and thus are not limitative of the present invention, and wherein.

DETAILED DESCRIPTION OF THE PREFERRED EMBODIMENTS

Figure 1:
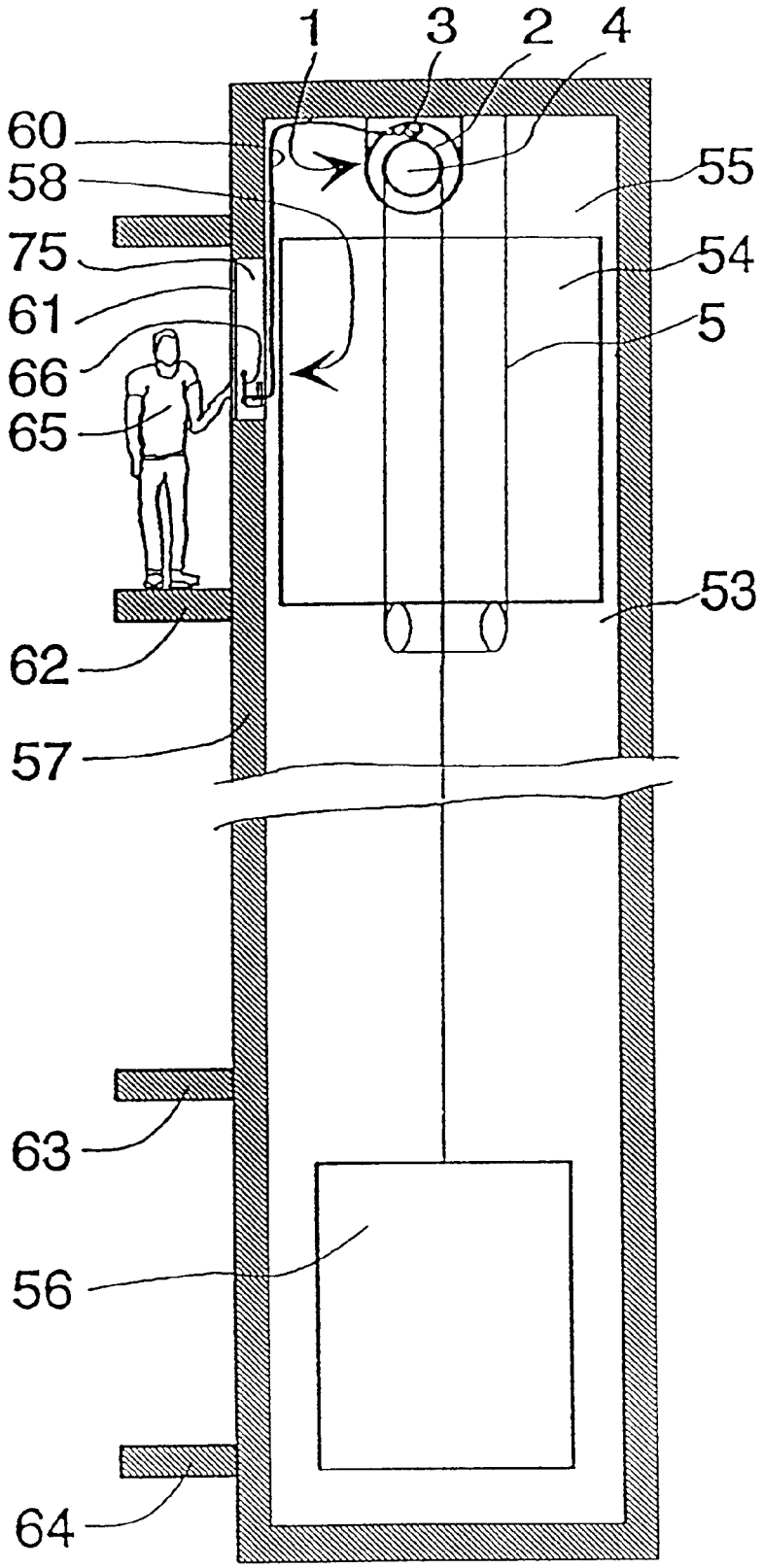
FIG. 1 illustrates the placement of the device of the invention.

FIG. 1 shows an elevator car 54 travelling vertically in an elevator shaft 53. The elevator is driven by an elevator machinery 1 suspended in the top part 55 of the elevator shaft. The elevator machinery 1 comprises an elevator motor 2, a brake 3 and a traction sheave 4. One end of the elevator ropes 5 is fastened to the top of the elevator shaft, from where the ropes 5 run via diverting pulleys under the elevator car 54 to the traction sheave 4 and then down to the counter, weight 56, to which the other end of the ropes 5 is attached.

Placed between the elevator machinery 1 and the wall 57 of the elevator shaft 53 is a brake releasing device 58 as provided by the invention. One end of the device is attached to the brake 3 and the other end is provided with an actuator 59 of the releasing device. The actuator 59 is placed in an opening 75 in the wall of the elevator shaft. The opening is protected by a cover 61 which can be opened and locked. The power required for releasing the brake is transmitted from the actuator 59 to the brake 3 by means of a mechanical power transmission element 60. A requirement regarding the placement of the actuator is that it must be possible to visually observe the elevator machinery while the brake is being released. The actuator 59 of the releasing device can therefore be located in a place other than an opening 75 in the wail, e.g. in the elevator shaft 53 or in a separate locked box placed near the shaft. To give a definition of the placement of the actuator 59 of the releasing device with respect to the elevator machinery 1, it can be stated that the actuator 59 is placed at a distance larger than immediate vicinity, which is to say that a person cannot reach the actuating element 50 of the releaser 47 of the brake 3 from where the actuator 59 is placed (see FIGS. 2 and 3). This inability to reach the actuating element may be due to the distance or a wall or other obstruction between the person and the actuating element. FIG. 1 also shows the floors 62–64 and, on floor 62, a person 65 operating the brake releasing device while simultaneously observing the operation of the elevator machinery 1.

Figure 2:
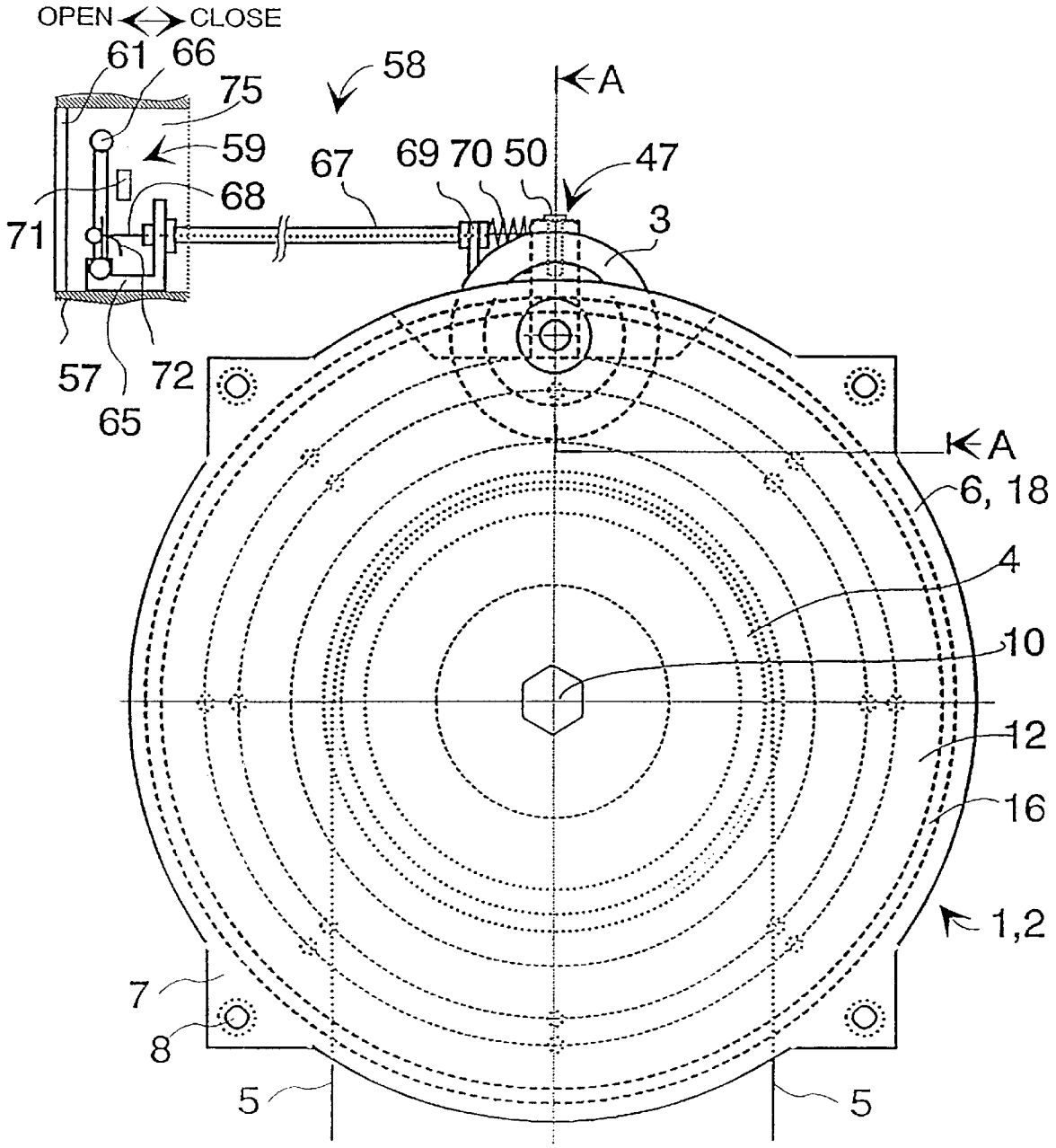
FIG. 2 presents a gearless elevator machinery with a brake releasing mechanism according to the invention.

FIG. 2 presents a front view of a gearless machinery 1 comprising a motor 2, a disc brake 3 and a traction sheave 4. The elevator ropes run downwards from the traction sheave 4. The motor is a disc-type motor in which the stator is built in a stator disc 18 and the rotor in a rotor disc 12. The elevator machinery has been put together by means of connecting elements 8 placed between lugs 7 provided in the stator disc 18 and in a support 6 attached to it and another connecting element 10 in the centre of the machinery for joining the support 6 and the stator disc 18 together. The structure of the machinery 1 allows several disc brakes 3 to be mounted on the support 6 and stator disc 18 by means of mounting elements provided in the brake units themselves. In the figure, only one disc brake has been mounted.

A releasing device 58 as provided by the invention is connected to the actuating element 50 of the brake releaser 47. The releasing device 58 comprises its actuator 59, which is provided with a turnable element 66 (lever) pivoted on the body 65 of the actuator 59. Connected to the turnable element 66 (lever) is a mechanical power transmission element 60 consisting of an axially rigid tube 67 and a wire or rope 68 inside it. One end of the tube 67 is attached to the body 76 of the actuator 59 and the other end to a support 69 fixed to the brake 3. One end of the rope 68 inside the tube is attached to the turnable element 66 and the other end to the actuating element 50 of the brake releaser 47. When the turnable element 66 (lever) is turned in the OPEN direction, the rope 68 moves in the same direction and turns the actuating element 50, releasing the brake 3. When the lever is returned to the CLOSE position, a spring 70 placed between the support 69 and the brake 3 returns the releasing device 58 back to the braking position. The releasing device is provided with a detector 71 indicating its functional status, which detector can be connected to the elevator control system. Attached to the turnable element 66 (lever) is an arched support 72 placed under the rope 68 and turning with the lever, thus maintaining a constant value of the moment arm acting on the rope 68. This prevents the transmission of an excessive pull when the lever is being turned.

Figure 3:
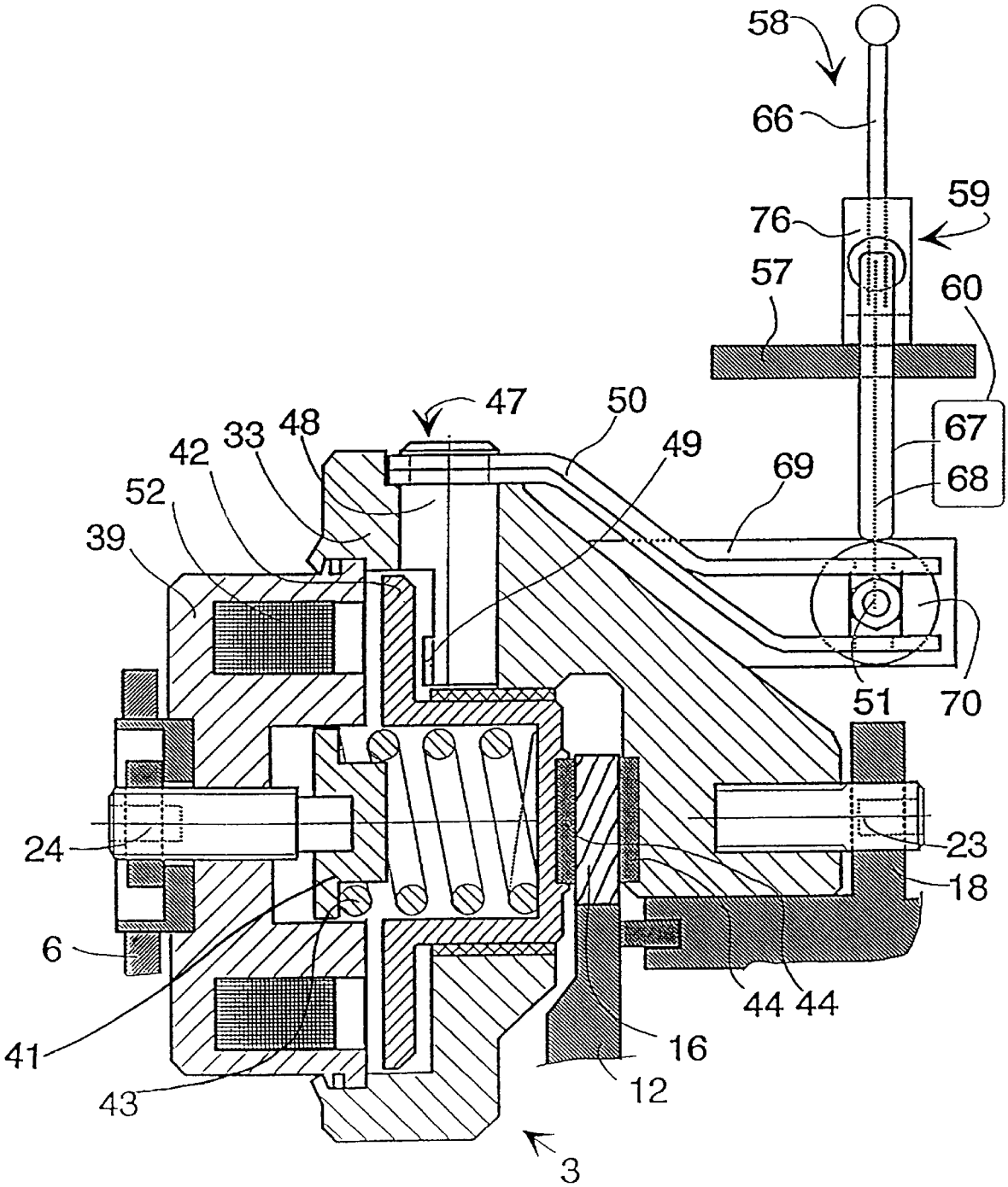
FIG. 3 presents a sectional view of the elevator machinery, showing the brake

FIG. 3 presents a magnified section of the disc brake, taken along line A—A in FIG. 1.

Attached to the rotor disc 12 is an annular brake disc 16 forming an extension of the periphery of the rotor disc 12 in its radial direction. The disc brake 3 is floatably mounted by means of attachments on both sides of the brake disc 16, ensuring that the disc brake is centered with respect to the brake disc 16 during braking. The floatable mounting of the disc brake is implemented using detachable brake supporting elements 23 and 24, by means of which the disc brake is attached on one side to the stator disc 18 and on the other side to the support 6 attached to the stator disc 18. By removing the supporting elements 23 and 24, the disc brake 3 can be detached as a whole unit from the stator disc 18 and the support 6 attached to it.

The cover 39 and the anchor 42 of the disc brake are made of ferrorr,agnetic material and a magnetic coil 52 is placed inside the cover. When the magnetic coil is activated, the magnetic field attracts the anchor 42, thus causing the anchor and therefore the whole disc brake to disengage from the brake disc 16.

Between the anchor 42 and the spring block 41 there is an elastic element 43, preferably a helical spring, which pushes the anchor 42 and the spring block 41 in opposite directions, causing the anchor 42 to be thrust towards the brake disc 16, thus producing a braking action when the magnetic coil is not activated. On each side of the brake disc there is a braking surface 44, attached to the outer surface of the anchor 42 and to the body 33 of the disc brake.

The disc brake is provided with a mechanical brake releaser 47 consisting of an actuating element 50 and an eccentric gear 48. When the actuating element 50 is turned, the eccentric gear 48 is rotated, causing the eccentrically placed element 49 to push the anchor 42 in the direction away from the brake disc 16, thereby releasing the brake.

The metal wire or rope of the power transmission element 60 of the brake releasing device 58 is attached to the actuating element 50 by means of a joining element 51. The force needed for releasing of the brake could of course be transmitted to the brake e.g. by means of a rod pressing the anchor 42 directly away from the brake disc 16. In this case, however, the power transmission element 60 of the releasing device 58 would be subjected to a large force, which is avoided by using a brake structure as presented in FIG. 3.

The invention can be applied in many ways. The element actually transmitting the force may be a wire or a rope 68 and the force for releasing the brake is transmitted to the brake by means of the power transmission element 60 either by a pushing or pulling movement of the wire, using a single wire as described above.

Figure 4:
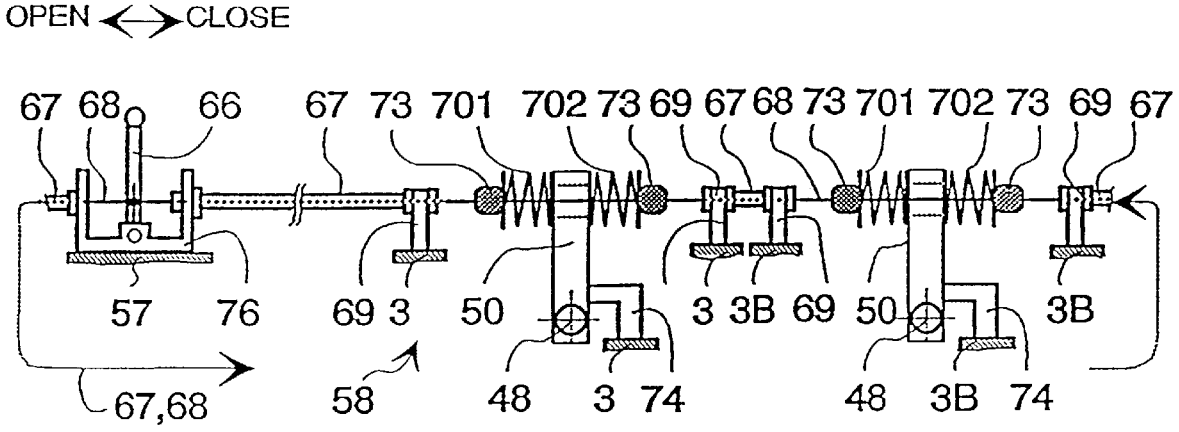
FIG. 4 presents another embodiment of the invention.

FIG. 4 presents another embodiment of the invention, in which the wire or rope 68 of the power transmission element 60 forms a mechanically closed loop used to release two brakes simultaneously. If desired, more than two brakes can be connected in a chain in this embodiment. In this system, the turnable element 66 (lever) is active both in the brake releasing direction (OPEN) and in the closing direction (CLOSE). In addition, the releasing device 58 is provided with a system designed to standardize the releasing and closing force for the brake, ensuring that the brakes are released and closed simultaneously.

The disc brakes 3 and 3B are placed in the elevator machinery in the manner illustrated by FIG. 3. The actuating elements 50 of the mechanical brake releasers 47 are each provided with a hole through which the wire or rope 58 of the power transmission element 60 is passed. Each brake has a support 69 on both sides of the actuator, to which the power transmission element 60 is attached. Placed on ether side of the actuating element 50 are springs 701 and 702. The length of the springs is determined by a fixed stop 73 attached to the wire or rope. The wire or rope (loop) of the power transmission element is connected to the actuator 59. When the pivoted lever 66 of the actuator is turned in the OPEN direction, tention in spring 702 exerts pressure on the actuating element 50. The distance between the stops 73 and the actuating element 50 is such that both brakes 3 and 3B are released at the same time. Correspondingly, when the lever 66 is turned in the CLOSE direction, the closing of the brakes also occurs simultaneously. The magnitude of the pressure of the strings 701 and 702 can be set to a desired level by moving the stops 73 to a suitable position on the wire or rope 58. Attached to the actuating element 50 is a part 74 which rests on the brake and turns clear of it with the actuating element. This part 74 centers the actuating element 50. Thus, the arrangement shown in FIG. 4 also prevents the generation of excessive forces acting on the releasing device 58. Excessive forces could be produced e.g. as a result of the power transmission element 60 being damaged.

Figure 5:
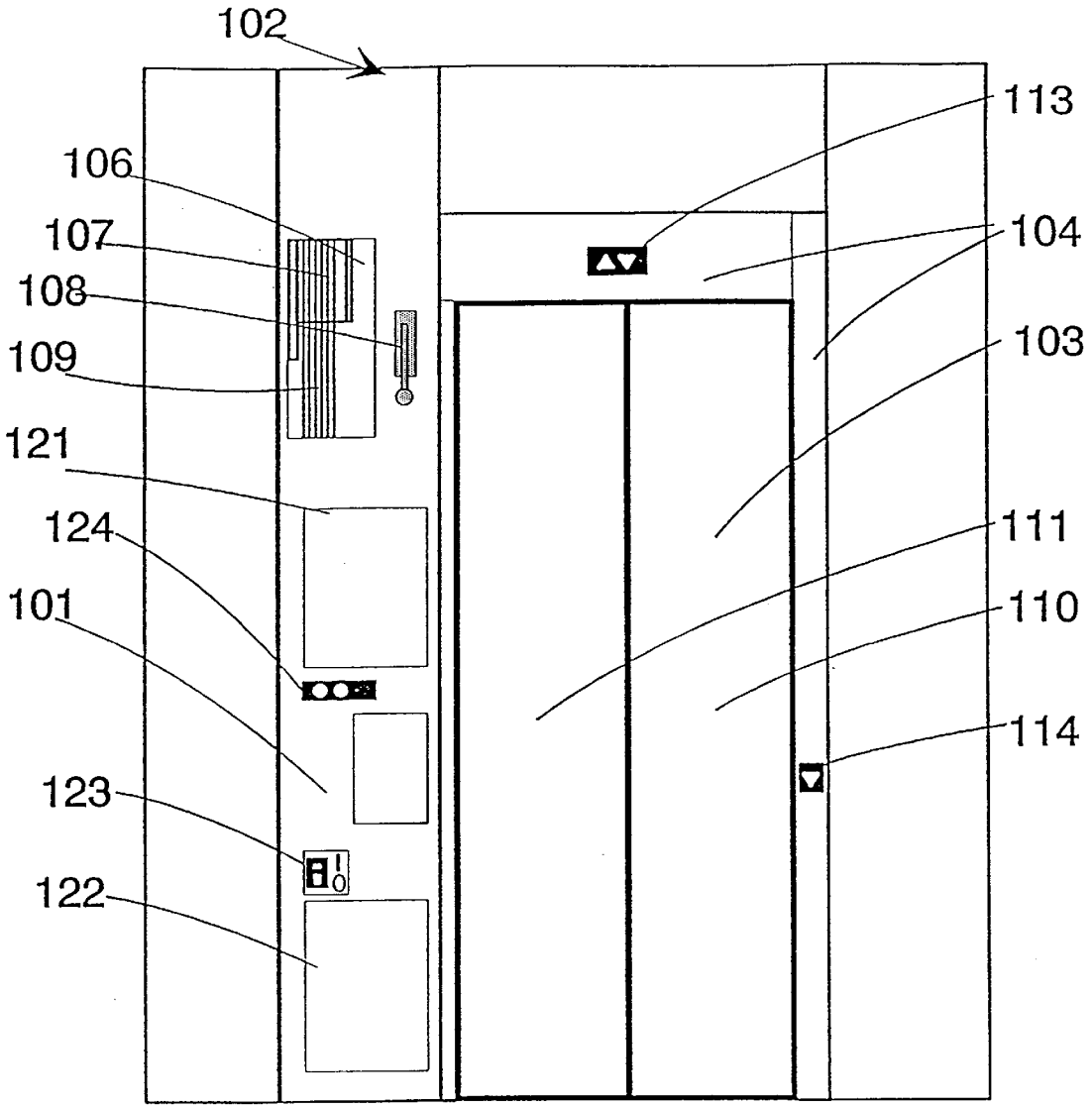
FIG. 5 and 6 present yet another embodiment of the invention.
Figure 6:
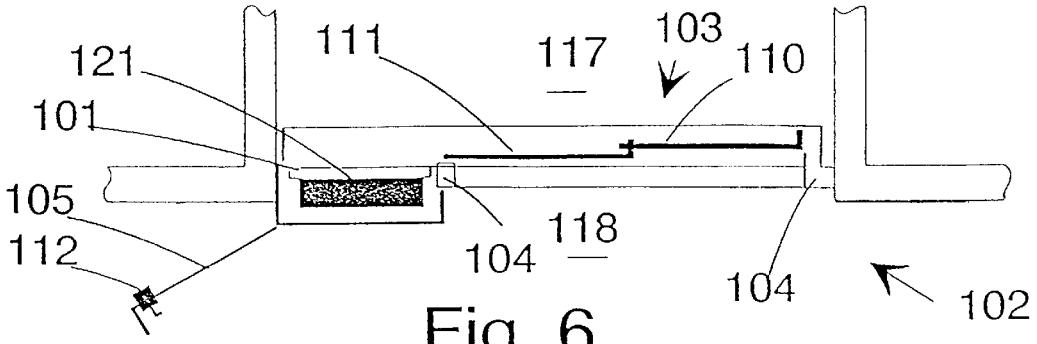

FIG. 5 presents an arrangement according to the invention as seen from the landing and with the cover 105 of the instrument panel 101 removed, and FIG. 6 presents a diagrammatic section of the lay-out of the door 103 and instrument panel 101 in an opening 102 between a landing 118 and the elevator shaft 117. The instrument panel 101 is an assembly containing at least the electric drive controlling the hoisting motor as well as elevator control equipment. The instrument panel 101 is placed in the same opening 102 between the landing and the elevator shaft as the door and is incorporated in the jamb structure 104 surrounding the door, being connected to it with a contact achieved e.g. by attaching the instrument panel 101 to the door jamb structure 104 or via common parts shared by the instrument panel 101 and the door jamb structure 104. In this context, the door jamb structure 104 is understood to be an assembly which, in addition to the visible parts surrounding the door 3 and the structures needed to retain these parts in place, may comprise the door frame and other conventional door supporting structures in the opening 102 or in its immediate vicinity. In front of the instrument panel 101 there is a sufficient working space on the landing e.g. for a serviceman servicing the elevator. From the instrument panel 101, the serviceman can also see the hoisting machinery through a window 106. The window may be an open aperture or a non-openable window provided with a glass pane or a net, or may be implemented as an openable hatch, in which case it may be either transparent or non-transparent. The window 106 is preferably placed at a height corresponding to the face level of a person standing on the landing, so that one can observe the hoisting machinery 107 via the window without bowing or standing on one's toes. Near the window and easily accessible to the person standing on the landing is a manual release handle 108 of the brake belonging to the hoisting machinery in the elevator shaft, the handle being preferably placed at a suitable height to allow it to be gripped by hand.

Through the window, one can also observe the ropes 109 and the traction sheave of the machinery. The window 106 may be part of the instrument panel 101, in which case looking through the window means looking through the instrument panel. Alternatively, the window may be placed in some other suitable location, such as the door jamb structure 104 above the door. As to its appearance, the landing on which the instrument panel is installed is like the other landings. The cover 105 may protrude from the opening 102 somewhat more than the door jamb sheets in the corresponding area on the other floors. This is because the instrument panel 101 cannot be sunk very deep into the jamb structure because there must be enough space behind the instrument panel 101 to permit movement of the door panels 110 and 111. In fact, the placement of the instrument panel could well be described by saying that the instrument panel is placed inside the jamb structure, under a cover 105 comprised in the jamb structure. Thus, no separate machine room is needed in the building because the hoisting machinery 107 is placed in the elevator shaft and the instrument panel 101 in the door jamb structure. The cover 105 may be removable or it may be so hinged that it can be turned aside off the instrument panel 101 like the cover in FIG. 6. The cover may have a construction consisting of one or more parts, and it is preferably provided with a lock 112 to allow it to be locked in place. The wiring to be connected to the instrument panel 101 can easily be laid in the elevator shaft 117. This wiring includes the conductors supplying electricity to the instrument panel and from the instrument panel to the electric motor driving the machinery, as well as the wiring between the elevator control system and the signal devices 113 and call buttons 114. The elevator controller 121, electric drive 122, main switch 123, emergency operating buttons 124 and other devices in the instrument panel 101 are accessible when the cover 105 is open. The instrument panel also contains a signal device which uses e.g. a signal light to indicate the presence of the elevator car in the anding zone of a given floor, in other words, to indicate that the elevator car is in a safe part of the elevator shaft for the passengers to leave the car. This signal device is provided with a battery or other type of reserve power source to ensure its functionality independently of external supply of power. Instead of a signal device, safe position of the elevator car can be indicated e.g. by painted markings made on the hoisting ropes or the overspeed governor rope, which markings a person can watch through the window 106 while observing the movement of the elevator.

It is obvious to a person skilled in the art that the embodiments of the invention are not restricted to the examples described above, but that they may instead be varied within the scope of the claims presented below. In particular, the brake to be released may be another type of brake instead of a disc brake.

We claim:

1. A device for releasing an elevator brake, said device comprising:

an actuator which generates a brake releasing force, said actuator being positioned on a landing away from the elevator brake so that, from a position near said actuator, movement of the hoisting ropes and/or traction sheave is viewable and an indication that the elevator car has arrived at a landing zone can be perceived from a position near the actuator; and a mechanical power transmission system for transmitting the brake controlling force from said actuator to a braking element.

2. The device as defined in claim 1, wherein said brake releasing device allows both releasing and closing of the brake.

3. The device as defined in claim 1, wherein said brake releasing device actuates a plurality of brakes simultaneously.

4. The device as defined in claim 1, wherein said brake releasing device is provided with a indicator which indicates whether said brake releasing device is in an OPEN or a CLOSE position.

5. The device as defined in claim 1, further comprising:

a lock-up cover protecting said brake controlling device.

6. The device as defined in claim 1, wherein said actuator is contained in a cabinet on a landing, said cabinet also containing electrical power and control equipment for the elevator, said cabinet further having a window which allows observation of the elevator ropes and/or hoisting machinery.

7. The device as defined in claim 1, further comprising:

means for providing a constant force for closing or releasing the brake.

8. The device as defined in claim 1, wherein said elevator brake releasing device is mounted near the elevator doors of the top floor of the building serviced by the elevator.

9. The device as defined in claim 1, wherein said actuator includes a manual lever, pivotable between an OPEN position and a CLOSE position, said actuator generating the brake releasing force when said lever is pivoted from the CLOSE position to the OPEN position.

10. The device as defined in claim 1, wherein the hoisting ropes and/or governor rope are marked to indicate to an operator when the elevator car is positioned at a landing.

11. The device of claim 1, further comprising:

an instrument control panel having a signal light which indicates the presence of the elevator car at a landing zone.

12. A method for releasing a elevator brake, said method comprising the steps of:

generating a brake releasing force when an operator activates an actuator, the actuator being positioned on a landing located away from the elevator brake, the actuator position allowing the operator to view the hoisting ropes and/or traction sheave and to perceive when the elevator car has arrived at a lading zone; and transmitting the generated brake releasing force from the actuator to a braking element.

13. The method of claim 12, wherein said elevator brake releasing method further comprises the step of:

generating a force for returning the brake to a closed state.

14. The method of claim 12, wherein said elevator brake releasing method releases a plurality of brakes simultaneously.

15. The method of claim 12, further comprising the step of:

indicating whether the brake is in an OPEN or a CLOSE position.

16. The method of claim 12, wherein the actuator is protected by a lock-up cover.

17. The method of claim 12, wherein the actuator is contained in a cabinet, the cabinet also containing electrical power and control equipment, the cabinet having a window which allows the user to observe the elevator ropes and/or hoisting machinery from the landing.

18. The method of claim 12, wherein said step of generating the brake releasing force is initiated when the operator pivots a manual lever from a CLOSE position to an OPEN position.

19. The method of claim 18, wherein the manual lever is located near the elevator doors of the top floor of the building serviced by the elevator.

* * * * *